United States Patent [19]

Konersmann

[11] 4,348,839

[45] Sep. 14, 1982

[54] METHOD FOR PRODUCING SURFACES AT A BLADE CUTTER HEAD FORMED OF HARDENED CUTTER BLADE STEEL

[75] Inventor: Erhard Konersmann, Zurich, Switzerland

[73] Assignee: Werkzeugmaschinenfabrik Oerlikon-Bührle, Zurich, Switzerland

[21] Appl. No.: 107,133

[22] Filed: Dec. 26, 1979

[30] Foreign Application Priority Data

Jan. 9, 1979 [CH] Switzerland ..... 152/79

[51] Int. Cl.[3] ..... B24B 1/00

[52] U.S. Cl. ..... 51/281 R; 51/288

[58] Field of Search ..... 51/277, 98 R, 220, 225, 51/277, 281 R, 288; 76/101 A, 101 R, 28, 29

[56] References Cited

U.S. PATENT DOCUMENTS

| | | | |
|---|---|---|---|
| 1,733,687 | 10/1929 | Klippel | 51/220 |
| 1,981,445 | 11/1934 | Aker | 51/225 |
| 2,367,521 | 1/1945 | Pero | 51/98 R |
| 2,612,082 | 9/1952 | Angell | 51/277 |
| 2,626,491 | 1/1953 | Penkoff | 51/220 |
| 2,648,173 | 8/1953 | Carroll | 51/277 |
| 3,990,329 | 11/1976 | Laurin | 76/101 R |

*Primary Examiner*—Harold D. Whitehead
*Attorney, Agent, or Firm*—Werner W. Kleeman

[57] ABSTRACT

A method for producing or forming cutting surfaces at the cutter blade head portion of a cutter blade formed of hardened steel is disclosed. The hardened steel blades, provided with a cutter blade head portion, are contemplated to be used in the cutter head of a gear cutting machine. In order to form the surfaces of the cutter blade head in a relatively short amount of time, without impermissible heating of the cutter blade steel, there is formed during a first step a pre-profile of the blade head by means of a cutting-off device containing a cutting-off grinding disk. During a further step the pre-formed surfaces of the pre-profile are ground into cutter blade surfaces at the heretofore conventionally used grinding machine. An apparatus for performing the method contains a rotatable bearing or support unit, adjustable into different positions, in which there is mounted the cutting-off grinding disk.

4 Claims, 5 Drawing Figures

METHOD FOR PRODUCING SURFACES AT A BLADE CUTTER HEAD FORMED OF HARDENED CUTTER BLADE STEEL

BACKGROUND OF THE INVENTION

The present invention relates to a new and improved method for producing surfaces at the blade head of a cutter blade formed of hardened steel for use in the cutter head of a gear cutting machine.

A steel cutter blade, suitable for use in a cutter head of a gear cutting machine, originally has a rod or bar-shaped configuration i.e. bar stock, with four-cornered cross-sectional shape. This steel cutter blade, prior to mounting at the cutter head, must be provided at one end thereof with a cutter blade head portion. The cutter blade head portion or blade head is formed by a number of surfaces which are more or less inclined with respect to the lengthwise axis of the steel cutter blade, and between two of these surfaces there is formed the actual cutting edge at a common edge or corner thereof.

To produce the surfaces of the cutter blade heads of the individual blades of a cutter head it is conventional practice to insert a number of steel cutter blades into a machine, typically of the type disclosed, for instance, in Swiss Pat. No. 450,949 and the corresponding U.S. Pat. No. 3,487,592. In such machine the same surfaces of the cutter blade head of the individual cutters or blades are simultaneously ground. This is accomplished such that the grinding disk is incrementally advanced towards the blades by fractions of a millimeter. Hence, the part of the steel cutter blade which is to be removed is ground away in layers, until there is exposed the desired surface of the cutter blade heads.

With this technique of forming the surfaces of the cutter blade head, it is necessary to usually remove a large number of layers of the material of the steel cutter blade. This requires an appreciable expenditure in both time and work. Hence, it is hardly possible to accelerate the grinding operation by only removing or machining away a few, but correspondingly thicker layers of material. It is to be appreciated that during grinding the output which is to be expended by the grinding machine is partially converted into heat at the surfaces of the steel cutter blade which are to be ground. The thickness of the layers which are to be machined thus should be chosen such that not too great amount of heat is delivered to the steel cutter blades, and between two successive passes of the grinding disk the last ground surface must be able to satisfactorily cool. If this is not so, then structural changes can arise at the surfaces of the steel cutter blade which are to be formed, and there are undesirably altered the properties of the steel cutter blade.

SUMMARY OF THE INVENTION

Therefore, with the foregoing in mind it is a primary object of the present invention to provide a new and improved method of producing surfaces at a cutter blade head formed of hardened cutter blade steel in a manner not afflicted with the aforementioned shortcomings and disadvantages of the prior art proposals discussed above.

Another and more specific object of the present invention is directed to a new and improved method, by way of means which it is possible to produce in a relatively short amount of time, without any appreciable heat transfer to the cutter blade head, the surfaces of the cutter blade head formed of hardened cutter blade steel.

One method by which the present invention is carried out is by use of a new and improved construction of apparatus for cutting surfaces at cutter blades formed of hardened blade steel, which apparatus is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the method aspects of the present development contemplate initially exposing surfaces of a pre-profile of the cutter blade by means of a cutting-off grinding disk, and thereafter post grinding in conventional manner the surfaces of the pre-profile of the cutter blade into surfaces of the cutter blade head.

Since for the cutting operation there can be used an appreciably greater output than for grinding, there is beneficially realized a notable reduction in the working time.

As mentioned above, the invention is concerned with the aforementioned method aspects, wherein a cutting-off grinding disk having a side surface confronting the steel cutter blade encloses an acute angle with a plane of movement of the cutting-off grinding disk, and means are provided for positioning the steel cutter blade.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
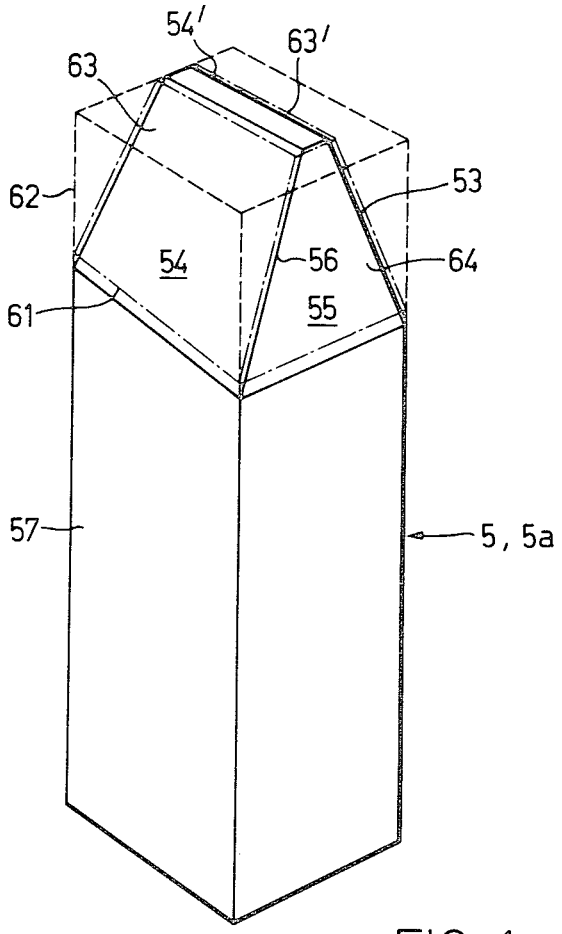
FIG. 1 is a perspective view of a steel cutter blade.

Describing now the drawings, FIG. 1 shows a steel cutter blade 5 having at one end thereof a cutter blade head or blade head portion 53. This cutter blade head 53 will be seen to comprise, for instance, apart from a front face 55, a flank 54 and a further, not here visible flank 54' situated opposite the flank 54. The flank 54 and the face 55 collectively form a cutting edge 56. Both of the flanks 54 and 54' and the face 55, in the embodiment under discussion, are inclined with respect to blade shank 57. The broken lines indicate the original bar shape 62 of the steel cutter blade 5. With chain-dot lines there has been illustrated a pre-profile or initial sectional shape 61 of the cutter blade head 53. Such likewise comprises flanks 63 and 63' and a front face 64.

Figure 2:
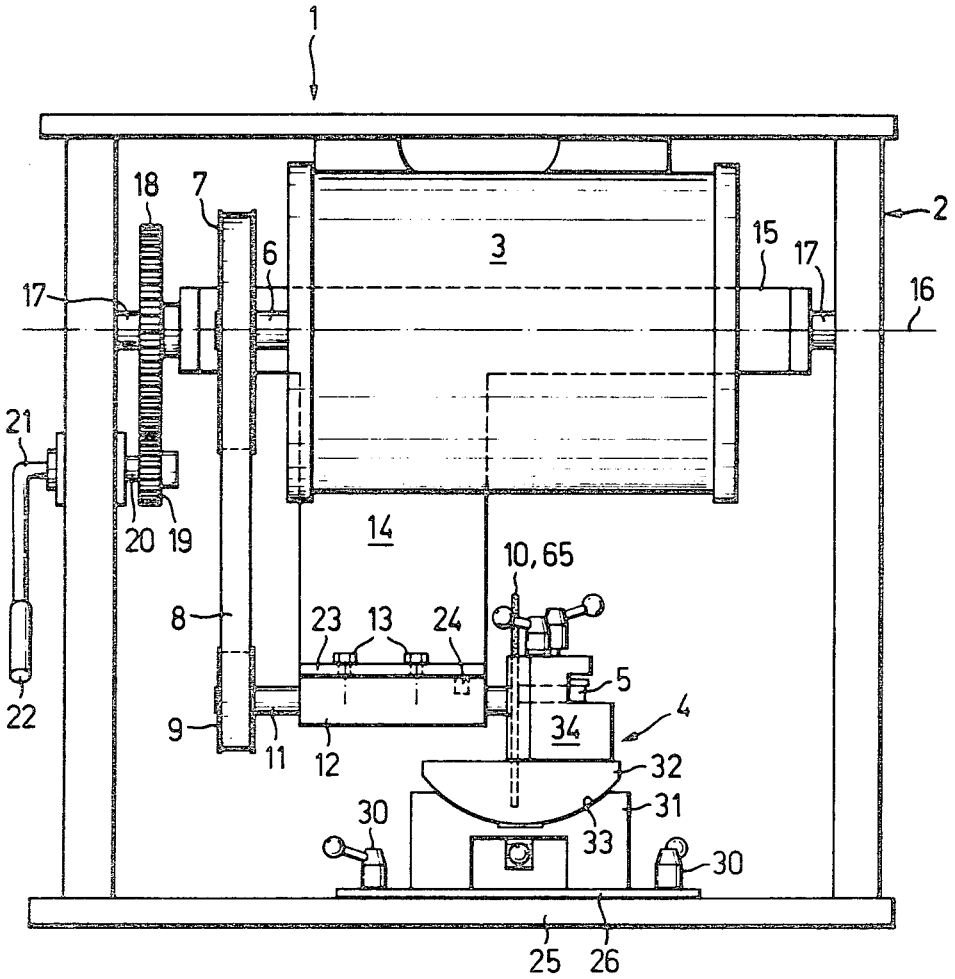
FIG. 2 is a front view on a reduced scale of a cutting-off device, typically a cutting-off grinder according to the invention.

Turning attention now to FIG. 2 there is illustrated therein a cutting-off device, for instance a cutting-off grinder 1 composed of a frame 2, a drive motor 3 suspended in any suitable conventional manner at the frame 2, and a blade holder device 4 for a steel cutter blade 5. Arranged at a drive shaft 6 of the drive motor 3 is a wheel or pulley 7 which drives through the agency of a toothed belt 8 a further pulley or wheel 9. The pulley 9 is attached together with a material-removal or cutting-off tool 10, for instance a material-removal or cutting-off grinding disk 65, at a shaft 11. The shaft 11 is rotatably mounted in a bearing or support device or unit 12 and secured against axial displacement. The bearing or support unit 12 is attached by screws or threaded bolts 13 or equivalent fastening devices, by means of a plate 23, at the vertical portion 14 of a bracket 15. This bracket 15 is rotatably and coaxially pivotably mounted with a shaft 16 of the motor 3 by means of bolts 17 in the frame 2. At one side of the drive motor 3 there is mounted between the frame 2 and the bracket 15 a gear 18 upon the bolt 17 and which gear 18 is fixedly connected with the bracket 15. This gear 18 meshes with a further gear 19 having an appreciably smaller diameter. The gear 19 is attached to a shaft 20 which is mounted in the frame 2. The shaft 20 is connected with a lever 21, at one end of which there is provided a handle 22 or other suitable actuation device.

Figure 3:
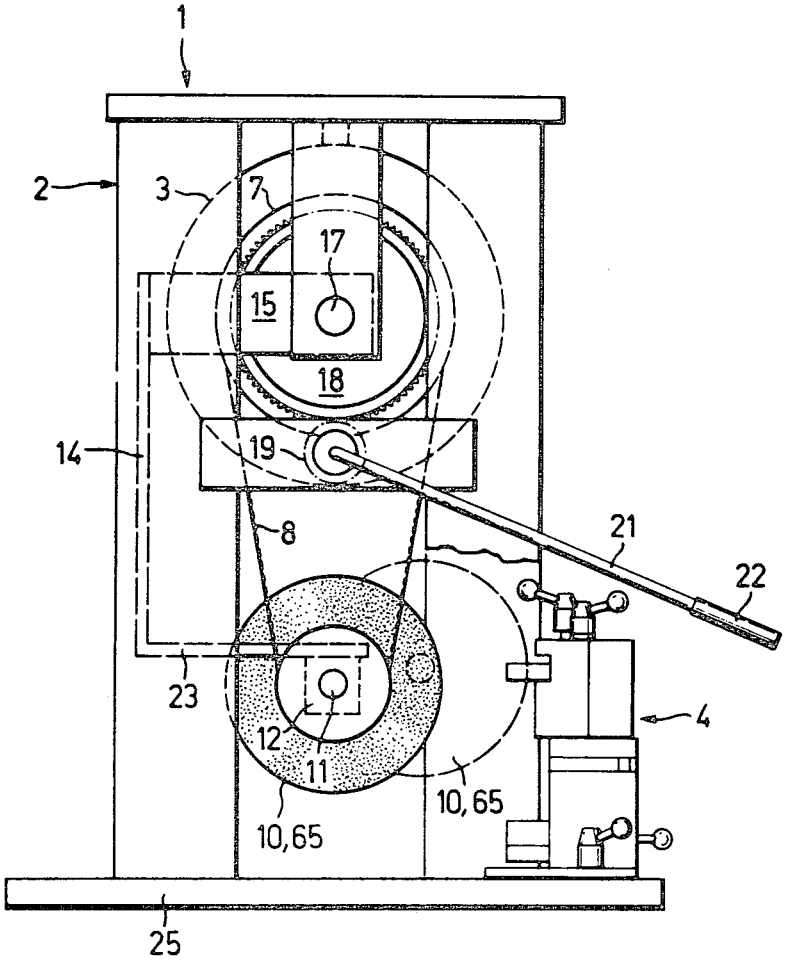
FIG. 3 is a side view of the cutting-off device shown in FIG. 2, partially illustrated in sectional view.

From the showing of FIG. 3 it will be particularly seen that the upright or vertical part 14 of the bracket 15 merges as its lower end with the horizontal plate 23. Conventional slots extending transversely to the shaft 11 are arranged in plate 23, these slots not being shown further here. These slots are intended as passageways for the likewise not here further illustrated shaft or shank of the threaded bolts or screws 13 (FIG. 2), so that the bearing or support unit 12 can be shifted into different positions and threadably fixed at the plate 23. In FIG. 2 there is indicated a pin 24 about which there can be rotated the bearing or support part 12, in order to be able to exactly adjust the position of the shaft 11. By referring to FIG. 4, there will be seen looking from the top, the blade holder device 4 which is displaceably arranged upon a first base plate 25, not shown in FIG. 4 but illustrated in FIGS. 2 and 3. Operatively associated with the blade holder device 4 is likewise a second base plate 26 in which there are provided slots 27 for a guide bolt 28 and slots 29 for clamping levers 30. As shown in FIGS. 2 and 5, a socket 31 is fixedly connected with the base plate 26. This socket 31 has an arcuate recess 33 capable of receiving a rocker or balance 32, as best seen by referring to FIG. 2. Mounted upon the rocker or balance 32 is a steel cutter blade holder 34. From below there is cut into the rocker or balance 32 a substantially T-shaped groove 35, as best seen by referring to FIG. 5. Arranged within the T-shaped groove 35 is a sliding block 36. The threading of clamping lever 37 protrudes into the sliding block 36, so that upon tightening the clamping or fixing lever 37 the rocker or balance 32 is retained in desired position.

Figure 4:
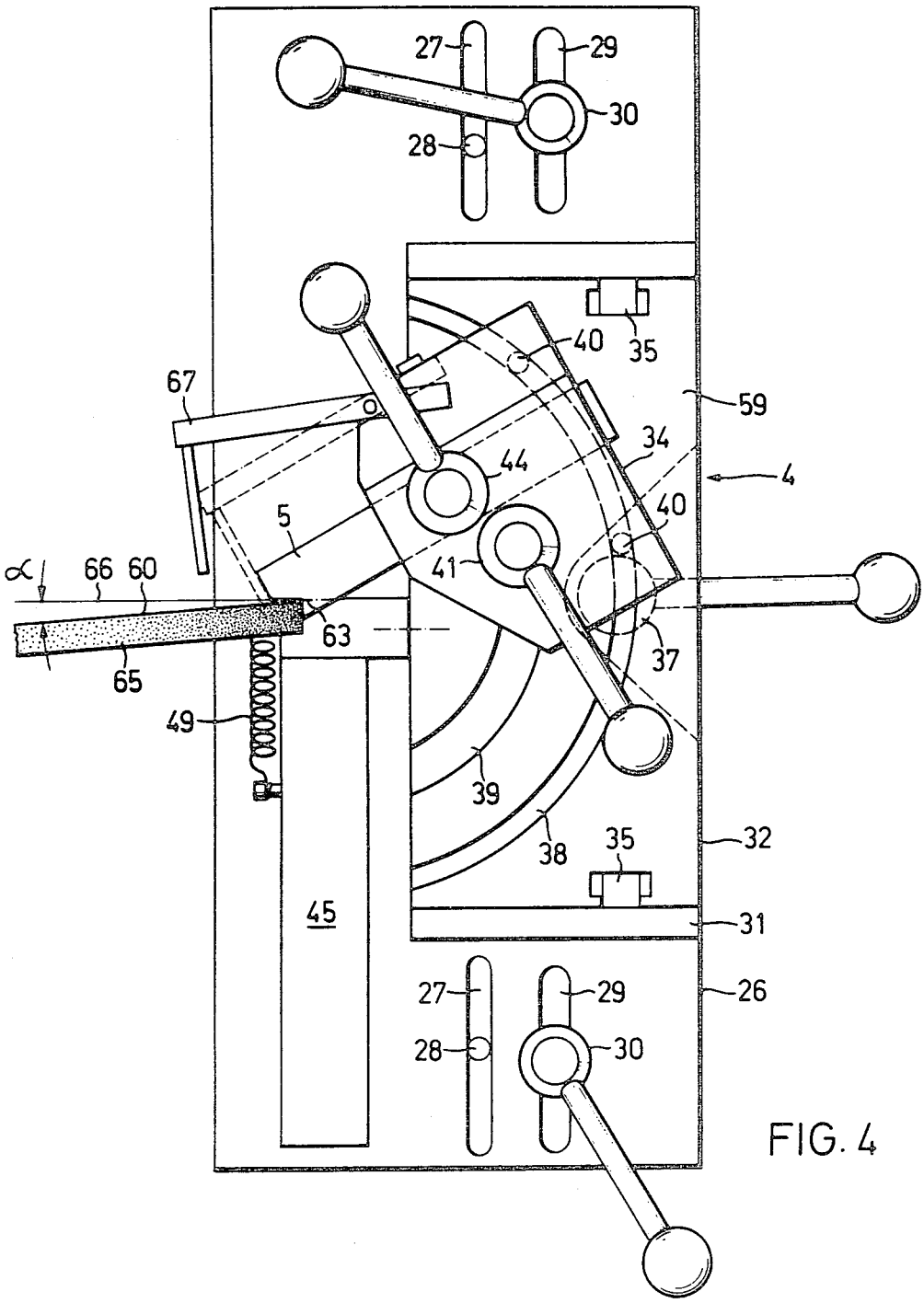
FIG. 4 is a top plan view of a holder device on an enlarged scale in relation to the illustrations of FIGS. 2 and 3.
Figure 5:
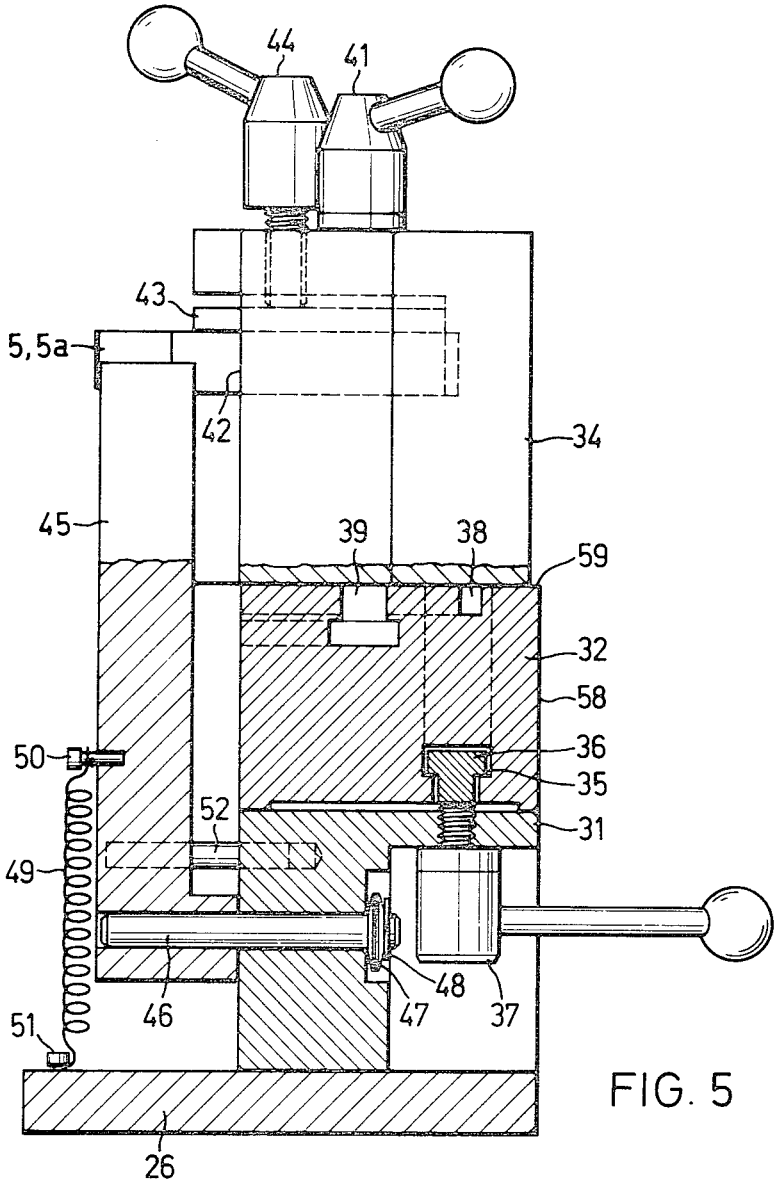
FIG. 5 is a side view of the holder device of FIG. 4, partially shown in sectional view.

Viewed from the top, as shown in FIG. 4, the balance 32 has a groove 38 and a substantially T-shaped groove 39. Engaging into the groove 38 are two pins 40 for guiding the cutter blade holder 34. A not here particularly visible but standard sliding block is arranged within the groove 39 which, in known manner, coacts with a further clamping or fixing lever 41 such that it is thus possible to fixedly retain the cutter blade holder 34 upon the balance or rocker 32. As best seen by referring to FIG. 5, within a recess 42 in the cutter blade holder 34 there can be inserted the steel cutter blade 5. With the aid of a plate 43 and a further clamping lever 44 is it possible to fixedly clamp, in conventional fashion, the steel cutter blade 5 in the cutter blade holder 34. A tilt stop 45, as best seen by referring to FIG. 5, is secured to a shaft 46. This shaft 46 is rotatably mounted in the socket 31 and is secured against axial displacement by means of plate springs 47 and ring member 48. A spring 49 is arranged between a bolt 50 carried by the tilt stop 45 and the base plate 26. A screw 51 anchors such spring 49 at the base plate 26. A stop or impact member 52 is provided at the one side of the tilt stop 45. FIG. 4 shows the tilt stop 45 in its laid position.

In order to produce for instance the surface 63 of the pre-profile 61 of the cutter blade head 53 shown in FIG. 1, rod or bar-shaped steel stock 62 of the cutter blade 5 is inserted into the cutter blade holder 34 of the holder device 4 of the cutting-off device 1, and is positioned by means of a movable stop or impact member 67 in its lengthwise direction and fixed in place by clamping lever 44. For adjusting the position of the cutter blade holder 34 in relation to the base plate 26 there can be arranged standard scales both at one side surface 58 as well as also on the top surface 59 of the balance or rocker 32. Markers are appropriately provided at the socket 31 and at the steel cutter blade holder 34. The scales and markers are not here further shown in the embodiment under discussion since the same are conventional. Once there has been located the desired position, then the clamping levers 37 and 41 are also tightened. Thereafter, there is still to be adjusted the lateral spacing of the holder device 4 from the cutting-off grinding disk 65 and such then is fixed by means of the clamping lever 30 at the base plate 25.

For the cutting-off or material-removal operation the lever 21 is downwardly urged by means of the handgrip or handle 22, as best seen by referring to FIG. 3, and this cutting-off or material-removal operation is performed with the drive motor 3 running—this drive motor 3 drives by means of the shaft 6, pulley 7, toothed belt 8, pulley 9 and shaft 11, the cutting-off grinding disk 65. This downward movement of the lever 21 is transmitted by means of the gears 18 and 19 to the bracket 15, which then rocks against the holder device 4. The gears 18 and 19 are designed such that the force which is applied by the handgrip 22 to the cutting-off device 1, is augmented and now presses the cutting-off grinding disk 65, shown in broken lines in FIG. 3, against the steel cutter blade 5. A here not further shown stop limits the movement of the cutting-off grinding or grinder disk 65 against the holder device 4.

After there has been completed the cutting-off or material-removal operation the cutter blade 5 is removed out of the holder device 4 and is again clamped or chucked in order to produce the other surfaces 63′ and 64 shown in FIG. 1. If the pre-profile 61 of the cutter blade head 53 has been formed, then in known manner there are ground at a conventional cutter blade grinding machine, such as the equipment disclosed in the aforementioned U.S. Pat. No. 3,487,592 the face and flanks 64, 63, 63′ into the face and flank surfaces 55, 54, and 54′, respectively, which has not here been further illustrated since these procedures are well known in this technology.

As already mentioned, it is advantageous for the cutting-off or material-removal operation to have sufficient power output available. As best seen by referring to the drawings, the dimensions of the employed drive motor 3 are appreciable in relation to the cutter blade 5 which is to be worked. This is so in order to be able to perform the cutting-off or pre-profiling operation rapidly and without any long lasting heat transfer to the steel cutter blade 5.

As best seen by referring to FIG. 4, it has been found to be advantageous to position the cutting-off grinding disk 65 such that one side or face 60 of the cutting-off grinding disk 65 does not unnecessarily contact the already produced part of the surface and thus heats the same. For this purpose the bearing or support unit 12, with the screws or bolts 13 loosened, can be rotated about the pins or plug 24. As a result, the cutting-off grinding disk 65 assumes the position shown in FIG. 4 and the side or face 60 encloses an angle $\alpha$ with the line 66 shown intersecting the plane of contact of the cutting-off grinding-disk 65. This effect can be realized, for instance, also with a not here shown cutting-off grinding disk 65 which is constricted or tapered towards the center.

A further embodiment of the inventive method resides in using a cutter blade head pattern or template 5*a* for setting the holder device 4. In this case the side surface of the tilt stop 45, confronting the steel cutter blade 5, should come to rest in its position, according to FIG. 5, in the movement plane of the grinding disk 65 of the cutting-off tool 10. Otherwise, this is to be insured for by loosening the clamping levers 30 and appropriately shifting the base plate 26. With upwardly tilted-tilt stop 45, as shown in FIG. 5, the balance or rocker 32 and the steel cutter blade holder 34 are positioned with respect to one another such that, for instance, the flank 63 of the cutter pattern or cutter blade head pattern 5*a* bears against the tilt stop 45. For the cutting-off or material removal or separation work the tilt stop 45 is downwardly tilted, as shown in FIG. 4, and the cutter pattern 5*a* is replaced by a steel cutter blade 5. The position of the steel cutter blade 5 along its lengthwise axis in the cutter blade holder 34 can be adjusted, for instance, for the cutter blade head pattern 5*a* and the cutter blade 5, by means of the stop 67.

A further development of the inventive method contemplates that the cutter pattern 5*a*, which of course serves as the pattern or model for an entire series of cutter blades, is formed from an easily machineable material upon a conventional cutter grinding machine.

While there are shown and described present preferred embodiments of the invention, it is to be distinctly understood that the invention is not limited thereto but may be otherwise variously embodies and practiced within the scope of the following claims. Accordingly,

What I claim is:

1. A method of producing cutting surfaces on a cutter blade head of a cutter blade, formed of hardened steel, for use in a cutter head assembly of a gear cutting machine, comprising the steps of:

producing blade surfaces of a pre-profile of the cutter blade head by means of a cutting-off grinding disk having a front surface and a side surface;

forming an acute angle with a plane of movement of the cutting-off grinding disk along the side surface of the cutting-off grinding disk such that said side surface does not substantially cut part of the cutter blade head already cut by the front surface of the cutting-off grinding disk;

moving the cutting-off grinding disk in its plane of movement in order to confront the cutter blade head and to produce the cutting surfaces on said cutter blade head; and thereafter grinding the pre-profiled blade surfaces of the pre-profile of the cutter blade head at a cutter blade grinding machine;

whereby excessive heating of the cutting surfaces produced on the cutter blade head is avoided.

2. The method as defined in claim 1, further including the steps of:

setting a holder device for the cutter blade relative to a cutting-off grinding disk by means of a cutter blade head pattern.

3. The method as defined in claim 1, further including the steps of:

producing a cutter blade head pattern from an easily machineable material upon the cutter blade grinding machine.

4. The method as defined in claim 1, further including the step of:

passing a line of intersection of the side surface of the cutting-off grinding disk with the plane of movement of said cutting-off grinding disk through the cutter blade head after the confronting step and before the grinding step.

* * * * *